United States Patent [19]

Males

[11] 4,444,347

[45] Apr. 24, 1984

[54] STAPLING DEVICE FOR USE WITH WIRE STAPLE SUPPLY

[75] Inventor: Robert E. Males, West Warwick, R.I.

[73] Assignee: Textron Inc., Providence, R.I.

[21] Appl. No.: 340,045

[22] Filed: Jan. 18, 1982

[51] Int. Cl.[3] ..... B25C 5/08

[52] U.S. Cl. ..... 227/88

[58] Field of Search ..... 227/85, 87–89

[56] References Cited

U.S. PATENT DOCUMENTS

| | | | |
|---|---|---|---|
| 447,428 | 3/1891 | Herr . | |
| 1,036,841 | 8/1912 | Heim . | |
| 1,637,357 | 8/1927 | Svenson . | |
| 1,708,314 | 4/1929 | Leschhorn | 227/88 |
| 1,897,625 | 2/1933 | Svensson . | |
| 2,459,313 | 1/1949 | Franz | 227/88 |
| 4,318,555 | 3/1982 | Adamski et al. | 227/88 |

*Primary Examiner*—E. R. Kazenske
*Assistant Examiner*—Douglas D. Watts
*Attorney, Agent, or Firm*—Cushman, Darby & Cushman

[57] ABSTRACT

A device for use with a staple supply in the form of a roll of wire including a housing assembly within which a single motion transmitting member is adapted to be moved by any suitable source of power through successive operating cycles each of which includes an operative stroke and a return stroke. The cycle of movement of the single member is used to effect operation of the usual wire stitching elements for handling and feeding the wire supply, cutting and forming an end section therefrom into a U-shaped staple, and driving the same. The mechanism for connecting the motion transmitting member with the inverted U-shaped member operable to cut and form the wire end section into a U-shaped staple includes a horizontally elongated pin receiving slot in the U-shaped member, a pin extending into the slot operatively retained therein for relative horizontal movement so that the U-shaped member is moved vertically in response to the vertical movement of the pin and pin engaging surfaces on the housing assembly and the motion transmitting member.

20 Claims, 15 Drawing Figures

STAPLING DEVICE FOR USE WITH WIRE STAPLE SUPPLY

This invention relates to stapling and more particularly to improvements in staple driving devices of the wire stitching type.

In the art of stapling, the more common device provided for accomplishing a stapling operation is the well-known desk stapler. Basically, desk staplers are devices which are used relatively infrequently and hence are available for use for extended periods of time without the necessity of replenishing the staple supply. Consequently, these devices are provided with staple supplies in the form of pre-formed staples adhered together by cement into a stick formation. This stick form of supply makes it possible to provide a simple driving mechanism and does not unduly complicate the time and difficulty involved in replenishing the staple supply.

Staples have been used in book making to secure a relatively small number of pages in folded condition. The staple driving devices provided for accomplishing an operation of this type are designed for relatively frequent use and hence spools of wire are utilized as a staple supply and the driving mechanism is provided with means for forming individual staples from the wire as a preliminary to the driving operation. While this arrangement complicated the driving mechanism it did greatly enhance the ability of the apparatus to function with relatively great frequency over relatively extensive periods of time without the necessity of replenishing the staple supply. Prior art devices of this type have been referred to as wire stitching machines and these machines have been available commercially throughout the 20th century. An example of a machine of this type proposed in the patented literature before 1900 is exemplified by the patent to Herr, U.S. Pat. No. 447,428 dated 1891.

Traditionally through the years wire stitching machines have been relatively bulky, heavy and expensive and therefore are justified basically for use only as production machines. Through the years efforts have been made to adapt wire stitching type machines to desk type devices, that is to provide a stapling device of the hand operated type which could be utilized with a wire spool staple supply. Examples of patents disclosing efforts of this type are as follows: U.S. Pat. Nos. 1,036,841; 1,637,357; 1,897,625; and 2,459,313.

However, no significant commercial adoption of these proposals has taken place. It can be logically concluded that one of the reasons for this lack of commercial acceptance is the added difficulty required in the manual operation of the devices by virtue of the necessity to perform all of the staple forming operations by manually movable parts in addition to the manual driving of the staple. Nevertheless there exist many situations where desk staples are being used at a frequency such that replacement of the staple supply in the form of staple sticks presents a bothersome problem. Indeed, not only is staple replacement in situations of this type a bother, but the frequency of use is such that considerable convenience could be provided by a power operation of the device as distinguished from a manual operation such as provided by the proposed manual wire stitching devices and conventional desk staplers. Existing power operated wire stitching machines, because of their bulk, complexity and cost, have simply not been used in these situations. Examples of situations of this type are the stapling machines used for example at airline counters; pliers or other stapling devices used at packaging counters, as, for example, in closing bags or the like. Another frequently encountered situation is the use of staplers in conjunction with copying machines, particularly in situations where the copying machines are being frequently used as distinguished from situations where a copying machine itself is only used occasionally. There exists, therefore, the need for a simple compact light-weight effective wire stitching mechanism capable of operation by a variety of different types of power, particularly fluid operated rams and the like, so that such mechanism can be embodied as a part of a self-contained unit or as a part of a larger piece of power operated equipment. For example, frequently it is desirable to incorporate a stapling mechanism in the collating equipment used in copying machines.

It is an object of the present invention to provide a device for use with a staple supply in the form of a roll of wire which meets the above-mentioned needs. In accordance with the principles of the present invention this objective is met by providing a housing assembly within which a single motion transmitting member is adapted to be moved by any suitable source of power through successive operating cycles each of which includes an operative stroke and a return stroke and by utilizing the cycle of movement of the single member to effect operation of the usual wire stitching elements for handling and feeding the wire supply, cutting and forming an end section therefrom into a U-shaped staple configuration and driving the same.

Preferably the wire feeding mechanism is of the type mounted on the housing assembly for successive vertical reciprocating cycles each of which includes a downward feeding stroke and a return stroke, the mechanism for transmitting the movement of the single motion transmitting member to the feeding mechanism being operable to effect a feed stroke which is greater in vertical extent than the portion of the operative stroke of the single motion transmitting member to which the feeding mechanism is responsive.

Another preferred arrangement embodied in the present device concerns the mechanism for connecting the motion transmitting member with the inverted U-shaped member operable to cut and form the wire end section into a U-shaped staple. In accordance with the principles of the present invention this mechanism includes a horizontally elongated pin receiving slot in the U-shaped member, a pin extending into the slot operatively retained therein for relative horizontal movement so that the U-shaped member is moved vertically in response to the vertical movement of the pin and pin engaging surfaces on the housing assembly and the motion transmitting member for (1) enabling the motion transmitting member to be moved through an initial portion of its operative stroke out of motion transmitting relation with the pin so that during such movement the U-shaped member can be retained in an initial stationary position, (2) enabling the motion transmitting member to be moved through a second portion of its operative stroke in motion transmitting relation with the pin so that during such movement the U-shaped member is moved vertically therewith and (3) enabling the motion transmitting member to be moved through a final portion of its operative stroke out of motion transmitting relation with the pin so that during such movement the U-shaped member can be independently biased to move downwardly. This preferred arrangement for effecting movement of the inverted U-shaped staple cutting and forming member is a desirable feature and is useful in wire stitching devices in general without regard to whether or not the motion transmitting member provided is used to accomplish the movement of all of the instrumentalities.

Another object of the present invention is the provision of a stapling device of the type described which is simple in construction, effective in operation and economical to manufacture and maintain.

These and other objects of the present invention will become more apparent during the course of the following detailed description and appended claims.

The invention may best be understood with reference to the accompanying drawings, wherein an illustrative embodiment is shown.

Figures 1, 2:
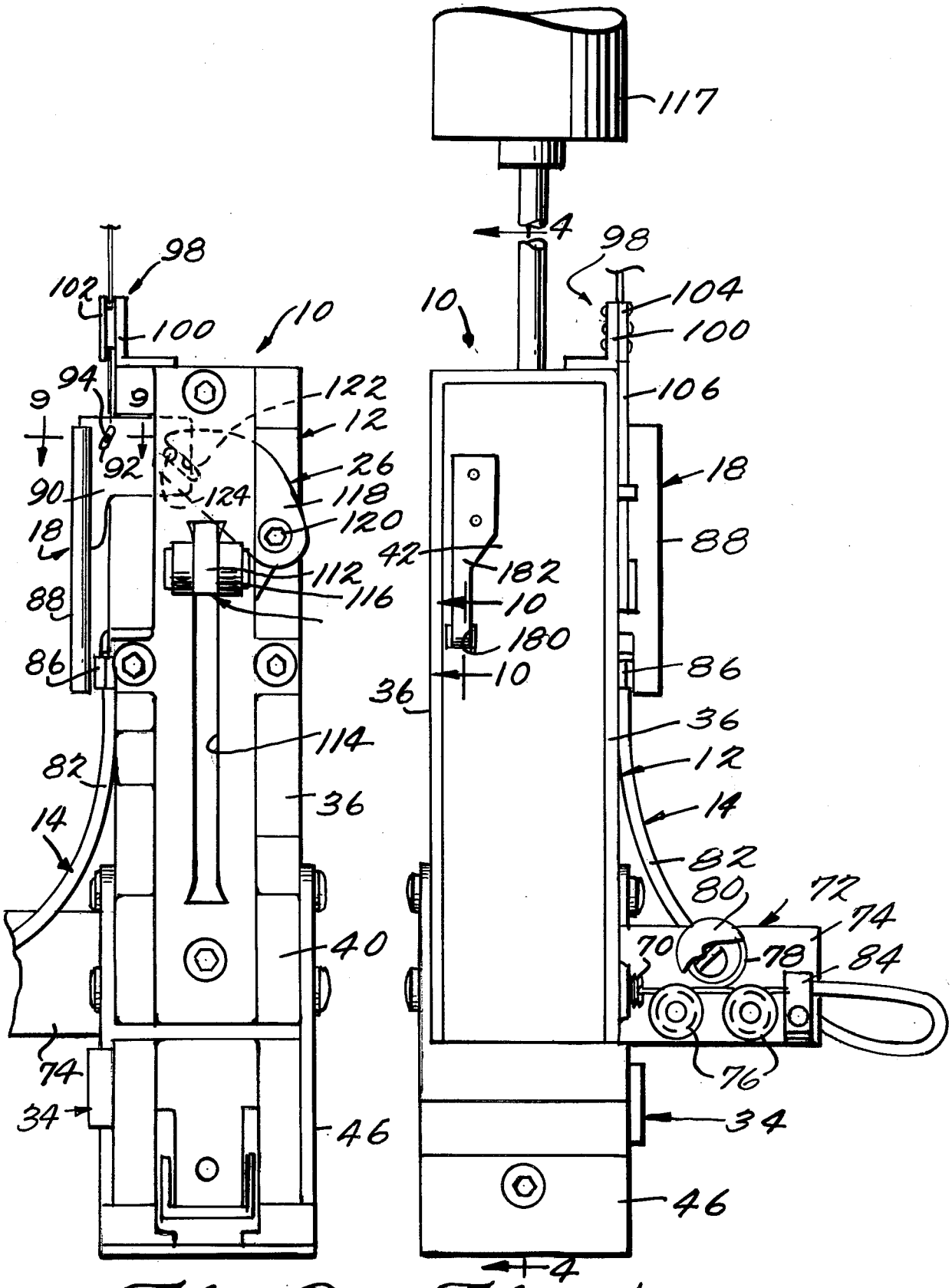
FIG. 1 is a front elevational view of a stapling device embodying the principles of the present invention.
FIG. 2 is a rear elevational view of the device shown in FIG. 1.

Referring now more particularly to the drawings there is shown therein a stapling device, generally indicated at 10, which embodies the principles of the present invention. The device 10 includes a housing assembly, generally indicated at 12, which carries thereon a staple wire supporting and guiding mechanism, generally indicated at 14, for supporting and guiding a roll of wire so that the wire can be unwound from the roll by extending an end portion thereof from the roll which is supported in guided relation along a downward path terminating in a horizontal path. Mounted on the housing assembly 12 in a position along the terminal horizontal path of wire movement is a wire receiving mechanism, generally indicated at 16, which serves to receive an end section of the wire disposed along the horizontal path. Mounted on the housing assembly 12 along the vertical wire path is a wire feeding mechanism, generally indicated at 18. The wire feeding mechanism 18 is mounted for reciprocating movement along the vertical wire path through successive operating cycles, each of which includes (1) a downward feeding stroke during which the end portion of the wire is moved with respect to the wire receiving mechanism 16 so that an end section thereof is received therein and (2) an upward return stroke. The wire receiving mechanism 16 serves to retain the end section of the wire in cooperating relation with a wire cutting and staple forming mechanism, generally indicated at 20, mounted on the housing assembly 12 for vertical reciprocating movement through successive operative cycles each of which includes (1) a downward cutting and forming stroke during which the end section of wire received by the wire receiving mechanism 16 is cut from the wire end portion and formed into a U-shaped staple and (2) an upward return stroke. Mounted on the wire cutting and staple forming mechanism 20 within the housing assembly 12 is a staple driving mechanism, generally indicated at 22. The staple driving mechanism 22 is mounted for vertical reciprocating movement through successive operative cycles each of which includes (1) a downward staple driving stroke during which a U-shaped staple formed by the cutting and forming mechanism 20, is driven through a workpiece and (2) an upward return stroke.

A motion transmitting mechanism, generally indicated at 24, is mounted on the housing assembly 12 for vertical reciprocating movement through successive operative cycles each of which includes (1) a downward operative stroke equal in vertical extent to that of the staple driving stroke of the staple driving mechanism 22 and (2) a corresponding upward return stroke. The motion transmitting mechanism 24 is operatively connected with the wire feeding mechanism 18 through a latched lever mechanism, generally indicated at 26, operable to effect movement of the wire feeding mechanism (1) through a downward feeding stroke in response to the movement of the motion transmitting mechanism 24 through an initial portion of its downward operative stroke of an extent less than the downward extent of the feeding stroke of the wire feeding mechanism and (2) through an upward return stroke in response to the movement of the motion transmitting mechanism through a portion of its upward return stroke.

The motion transmitting mechanism 24 is operatively connected with the wire cutting and stapling forming mechanism 20 by a pin and cam track mechanism 28, which serves to move the wire cutting and staple forming mechanism 20 (1) through a downward cutting and forming stroke in response to the movement of the motion transmitting mechanism 24 through an intermediate portion of its downward operative stroke of a vertical extent equal to the vertical extent of the cutting and forming stroke so that after an end section of wire has been moved into received relation with the said wire receiving mechanism 16 by the wire feeding mechanism 18, it is cut therefrom and formed into a U-shaped staple thereby and (2) through an upward return stroke in response to the movement of said motion transmitting member through a portion of its upward return stroke. The pin and cam track mechanism 28 is operable to accomplish the aforesaid cutting and forming stroke in a positive motion transmitting relationship. The motion transmitting mechanism 24 has a sequentially operative connection with the wire cutting and staple forming mechanism 20, as by a spring assembly 30, which serves to resiliently bias the cutting and forming mechanism downwardly into engagement with a workpiece so that the workpiece is effectively retained thereby during the subsequent driving of the staple therein.

The motion transmitting mechanism 24 is connected with the staple driving mechanism 22 directly as by a pivot pin 32. This direct connection of the pin 32 serves to move the staple driving mechanism 24 (1) through a staple driving stroke in response to the movement of the motion transmitting mechanism 24 through its downward operative stroke so that during the final portion thereof, a cut and formed staple is driven through the workpiece and (2) through an upward return stroke in response to the movement of the motion transmitting mechanism 24 through its upward return stroke.

While the stapling device 10 is capable of being used as a staple tacker during which a staple is simply moved into a workpiece, it is preferable to provide a clinching mechanism, generally indicated at 34. As shown, the clinching mechanism 34 is mounted on the lower end portion of the frame assembly 10 so as to receive the free ends of the legs of the staple as they pass through the workpiece and to bend over and clinch the free ends of the staple to the underside of the workpiece.

The housing assembly 12 may be of any suitable construction and as shown, preferably includes a main casting or frame member which provides two horizontally spaced side wall structures 36 rigidly retained in spaced relation along their upper portions by an integral top wall 38 and along their lower portions by an integral lower rear wall section 40. The front of the main casting is closed by a front wall member 42 which is of generally U-shaped cross-sectional configuration. The rear of the main casting is closed by a rear wall member 44. The lower end of the main casting is further supported by a clincher frame 46 which as shown, serves to receive and support the clincher mechanism 34 in its operative position.

The pin and cam track mechanism 28 includes a pair of vertically extending cam track members 48 which are mounted along the legs of the U-shaped front wall 42 at a position spaced inwardly from the bight portion of the front wall 42 so as to define with the latter a vertical guide track within which the wire cutting and forming mechanism 20 is reciprocally mounted.

Figures 8, 9, 10:
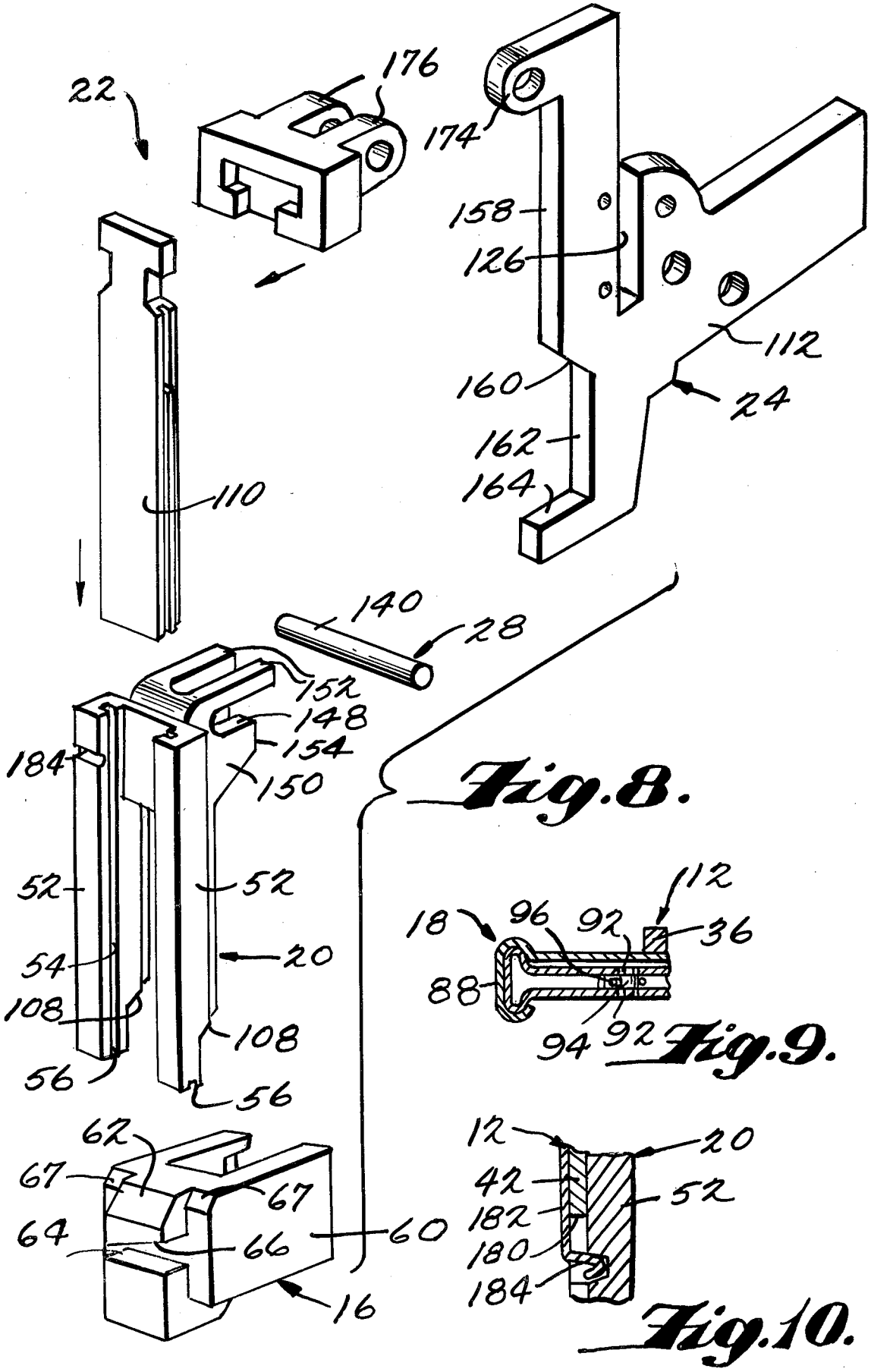
FIG. 8 is an exploded perspective view of certain component parts of the device.
FIG. 9 is an enlarged fragmentary sectional view taken along the line 9—9 of FIG. 2.
FIG. 10 is an enlarged fragmentary sectional view taken along the line 10—10 of FIG. 1.

As best shown in FIG. 8, the wire cutting and forming mechanism 20 includes an inverted U-shaped cutting and forming member 52, the legs of which have formed therein elongated vertically extended grooves 54. It will also be noted that the lower surfaces of the legs of the inverted U-shaped cutting and forming member 52 are formed with aligned horizontally extended grooves 56.

The lower portion of each of the cam track members 48 is formed with a horizontally extending guideway 58 within which an associated side of an anvil member 60 forming a part of the wire receiving mechanism 16 is mounted for horizontal reciprocation. Anvil member 60 includes a forwardly projecting portion having an inclined cam surface 62 formed along the upper edge thereof and a tapered slot formed therebelow which is defined along its lower perimeter by an upwardly facing wire supporting surface 64. As best shown in FIG. 8, the upper perimeter of the tapered slot is defined by an inclined guide surface 66. Formed along the upper edges of the anvil member 60 on opposite sides of the forwardly extending portion thereof is a pair of aligned cam surfaces 67. The purpose of the cam surfaces 67 as well as the central cam surface 62 will become more apparent hereinafter. The rearward portion of the anvil member 60 is recessed to receive one end of a coil spring 68, the opposite end of which seats against the lower frame section 40 of the main casting. Spring 68, serves to resiliently urge the anvil member 60 into an an outward operative position wherein the wire supporting surface 64 is disposed in a position below and between the lower ends of the legs of the wire cutting and forming member 52. The wire receiving mechanism 16 also includes an annular wire shearing member 70, the inner end which defines one end of the horizontal path, the opposite end of which is defined by the interior leg surface of the front wall 42 spaced horizontally in opposed relation thereto.

The wire supporting and guiding mechanism 14 includes a wire straightening assembly, generally indicated at 72, (see FIG. 1) leading to the annular wire shearing member 70. As shown, the wire straightening assembly 72 includes a frame 74 carrying a pair of lower horizontally spaced idler rollers 76. Mounted above and between the idler rollers 76 on the frame 74 is an adjustable roller 78. The vertical position of the adjustable roller 78 is adjusted by adjusting knob 80 which is rotatably carried by the frame 74 and provides an eccentric bearing for the adjustable roller 78. The wire supporting and guiding mechanism 14 also includes a transition tube 82 for bendingly guiding the end portion of the wire from the vertical path to the horizontal path. To this end, it will be noted that the discharge end of the transition tube 82 is retained in position as by a clip 84 on the straightener frame 74 so that the wire leaving the tube will be guided horizontally into the straightener assembly 72. The opposite end of the transition tube 82 is suitably fixed to the exterior of the housing assembly as by a clip 86 so as to receive the end portion of the wire extending along the lower end of the vertical path.

The wire feeding mechanism 18 includes a track forming guide member 88 which is suitably fixed to the exterior of the housing assembly 12 in a position adjacent the vertical wire path. The track forming member 88 serves to mount a pawl carrying member 90 for vertical reciprocating movement. As best shown in FIG. 9, the pawl carrying member 90 is preferably in the form of a single plate bent into a hollow T-shaped configuration in cross-section with the cross of the T being received within the track forming member 88. The pawl carrying member 90 is formed with aligned angular slots 92 for receiving therein a roller pawl 94 suitably spring pressed into a position adjacent the upper end of the aligned angular slots 92 as by a spring 96.

The wire feeding mechanism 18 also includes a holding pawl assembly generally indicated at 98, mounted in a position above the top wall 38 of the housing assembly 12. As shown, the holding pawl assembly 98 includes a frame plate 100 suitably fixed to the top wall 38 having rotatably mounted thereon an idler roller 102 for engaging one side of the wire as it moves downwardly through the vertical path. A holding pawl member 104 is suitably pivotably mounted on the frame plate 100 in a position to engage the side of the wire opposite that which is engaged by the roller 102. A band spring 106 serves to resiliently bias the holding pawl 104 into upward holding relation with the wire as by a camming action. This camming action prevents upward movement of the wire engaged by the holding pawl, but permits downward movement thereby.

The inverter U-shaped staple cutting and forming member 52 also includes rearwardly and downwardly facing inclined camming surfaces 108 which are adapted to engage the said camming surfaces 67 on the anvil member, it being noted that the camming surfaces 108 are positioned rearwardly of the legs so that as to engage on opposite sides of the central cam surface 62. The central cam surface 62 is disposed in a position to be engaged by the lower end of a staple driving element 110 forming a part of the staple driving mechanism 22. As best shown in FIG. 8, the staple driving element 110 has a generally rectangular cross-sectional configuration with tongues being integrally formed in the central portion of the end surfaces thereof, the tongues being slidable within the grooves 54 of the staple cutting and forming member 52. It is noted that the legs of the staple cutting and forming member 52 are rigidly interconnected along their upper end portions in such a way as to permit the staple driving element 110 to be moved downwardly between the legs.

The motion transmitting mechanism 24 consists essentially of an arm member 112 extending horizontally through a vertical slot 114 formed in the rear housing wall 44. As shown, the arm is mounted for vertical reciprocating movement along the vertical extent of the slot by a pair of rollers 116. Each pair of rollers 116 is mounted with its axis spaced on an oposite side of the rear wall 44 with the forward pair of rollers having its axis spaced slightly above the axis of the rearward pair of rollers. The rearwardly projecting end portion of the arm 112 is adapted to be connected with any suitable moving mechanism. The exemplary embodiment illustrated in the drawings is a hydraulic piston and cylinder movement indicated at 117 (see FIG. 1). It will be understood that any other type of actuator or moving mechanism may be utilized in lieu of the hydraulic piston and cylinder 117.

The latched lever mechanism 26 includes a motion transmitting lever 118 which is pivotally mounted on the main casting adjacent a cut out in one of the side walls 36 thereof, as by a pivot pin 120, as is best shown in FIG. 2. The opposite end of the lever 118 has a slot 122 formed therein which extends radially with respect to the axis of the pivot pin 120. Slot 122 receives a pin 124 carried by the inner end of the pawl carrying member 90 thereby establishing a vertical reciprocating movement of the latter in response to a pivotal oscillating movement of the lever 118. The arm 112 includes a portion disposed forwardly of the forward roller 116 which defines an upwardly opening slot 126 for receiving the central portion of the lever 118 therein.

Figure 4:
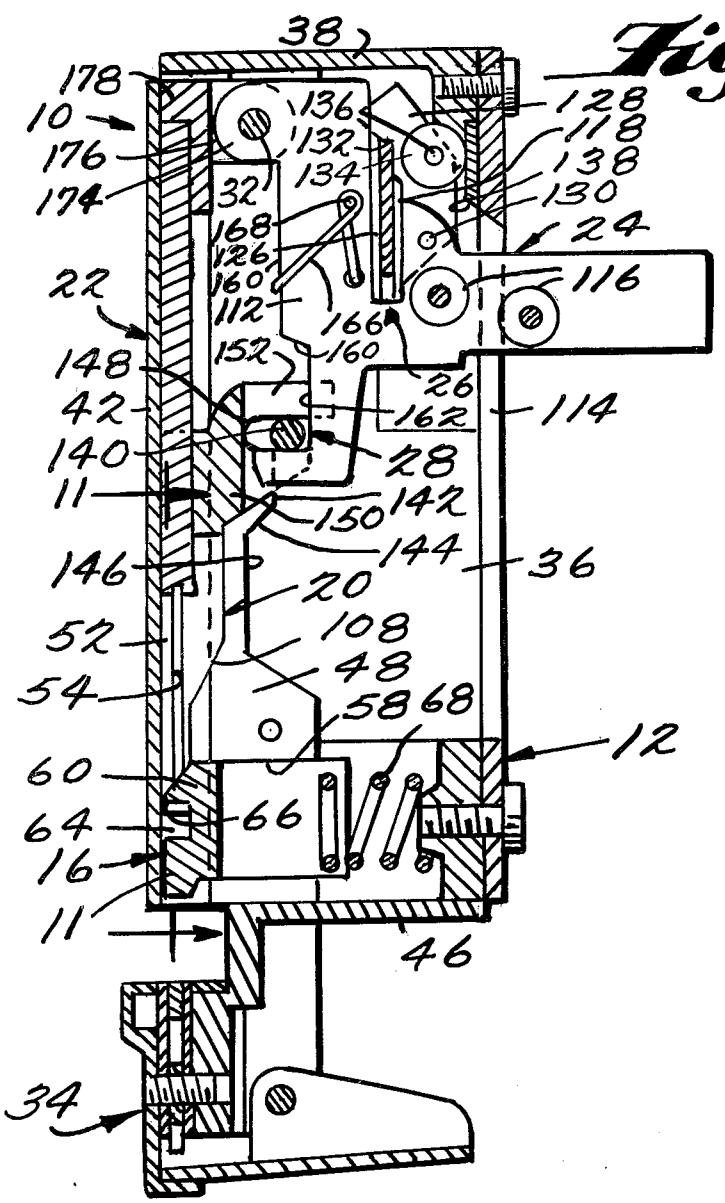
FIG. 4 is a vertical sectional view taken along the line 4—4 of FIG. 1, showing the position of the parts in their normal at-rest position.
Figure 7:
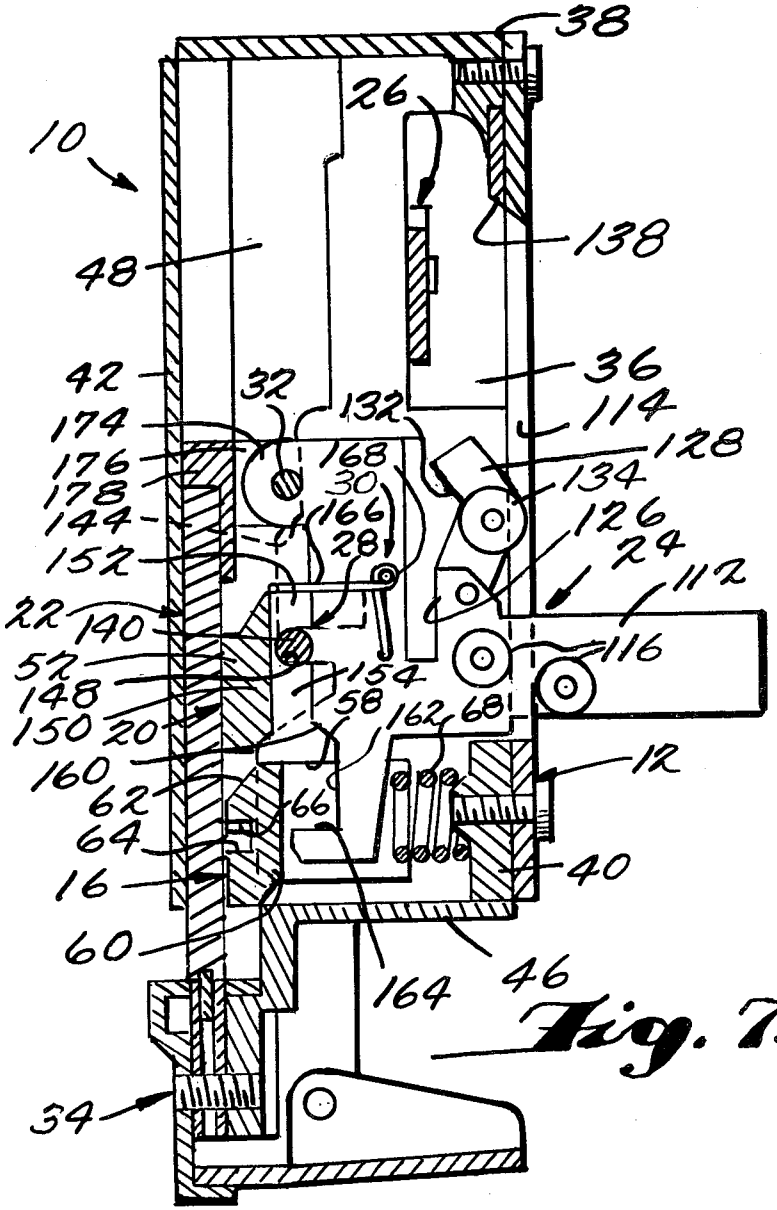
FIG. 7 is a view similar to FIG. 4 showing the position of the parts after the motion transmitting member has been moved through a final portion of its operative drive stroke.
Figure 6:
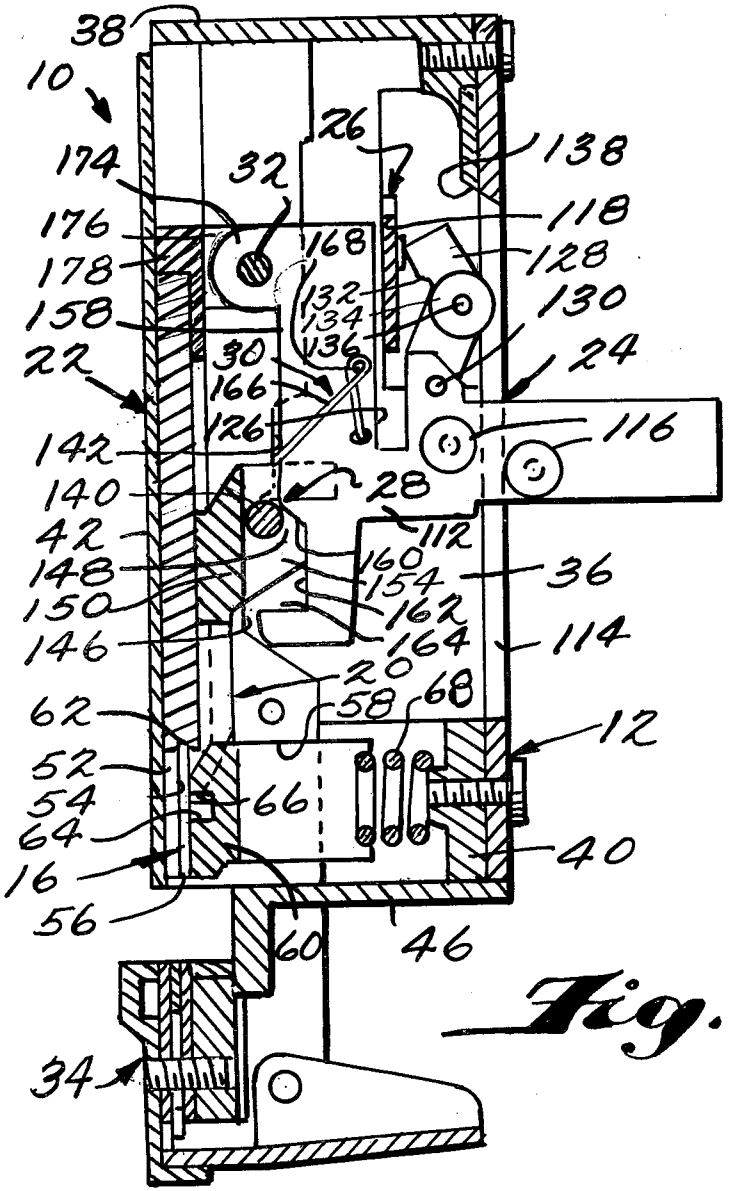
FIG. 6 is a view similar to FIG. 4 showing the position of the parts after the motion transmitting member has been moved through a second intermediate position of its operative drive stroke.

The latched lever mechanism 26 also includes a latch member 128 which is pivotally mounted on a portion of the arm 112 disposed rearwardly of the slot 126, as by a pivot pin 130. The latch includes a downwardly facing lever engaging surface 132 which is adapted to engage the central portion of the lever 118 when the latter is engaged within the slot 126 and the lever member 128 is disposed in a lever retaining position as shown in FIG. 4. The latch member 128 is adapted to be moved out of its lever retaining position under the control of a cam roller 134 rotatably mounted on the latch member as by a shaft 136. In its latched position cam roller 134 engages a cam track 138 which leads to the slot 114. As cam roller 134 rollers along the cam surface 138, latch member 128 is allowed to move rearwardly, permitting the lever member 118 to remain in the position into which it has been moved by the latch member while the arm member 112 continues its downward movement through its operative stroke.

The pin and cam track mechanism 28 includes a pin 140 which extends between the legs of the front wall 42 at a position rearwardly of the cam track members 48. As shown, the cam track members 48 include aligned upper vertical rearwardly facing track surfaces 142 against which the ends of the pin are adapted to roll. These cam track surfaces 142 lead to the upper end of rearwardly and downwardly facing inclined transition surfaces 144 which, in turn, lead to the upper end of lower cam track surfaces 146 which are horizontally forwardly offset from the upper surfaces 142 by an amount greater than the diameter of pin 140. Pin 140 is also adapted to engage within a horizontally extending slot 148 provided by a bifurcated portion 150 extending rearwardly from the bight portion of the inverted U-shaped cutting and forming member 52. As shown, the upper end of the slot 148 is defined by rearwardly extending arm portions 152 while the lower end thereof is defined by arm portions 154 having a rearward extent less than the rearward extent of the upper arm portions 152, an amount greater than the diameter of pin 140. The arm portions 152 and 154 are spaced apart so as to receive therebetween a lower forward portion of the arm 112. The arm portion has formed in the forward surface thereof a forwardly facing vertical surface 158, the lower end of which leads to a downwardly and forwardly facing pin engaging surface 160 which, in turn, leads to a forwardly facing vertical surface 162 which, in turn, leads to an upwardly facing pin engaging surface 164 which extends forwardly beyond the forward extent of the inclined surface 160.

Spring means 30 is preferably in the form of a wire torsion spring 166 which includes an intermediate coil portions engaged on a pin 168 carried by the portion of the arm 112 disposed forwardly of the slot 126. The spring 166 includes anchored ends which extends through an opening in the arm 112 and a central portion which is disposed in a position to engage the upper surface of the upper arm portions of the bifurcated portion 152.

The pin 32 connecting the arm 112 and staple driving element 110 extends between a forwardly extending aperture lug portion 174 on the arm 112 and a pair of rearwardly extending aperture lugs 176 formed on the rear of a guide member 178 forming a part of the staple driving mechanism 22. As shown, the ends of the guide member 178 are slidably mounted within the housing assembly 12 in the same manner as the staple cutting and forming member 52 in a position thereabove. The guide member 178 is connected with the staple drive element 110 by forming the upper end of the staple driving element in a T configuration and providing a T slot in the forward portion of the member 178 to receive the T portion therein.

Referring now more particularly to FIG. 10, it will be noted that there is formed in the front portion of the front wall 42 an opening 180 for receiving therethrough a rearwardly extending end of a spring detent member 182 fixed to the forward exterior surface of the front wall 42. The rearwardly extending end of the spring detent 182 is adapted to engage within a notch 184 formed in the forward surface of the lefthand leg of the wire cutting and forming member 52. When the spring detent is engaged within the notch 184 the member 52 is disposed in its uppermost position.

OPERATION

The operation of the device 10 will be described with the parts oriented in the position shown in the drawings, however, it will be understood that the device is capable of operation in any orientation and consequently directional terms such as vertical, horizontal, upwardly and downwardly and the like, are herein used in their relative sense rather than in their absolute sense.

Figure 11:
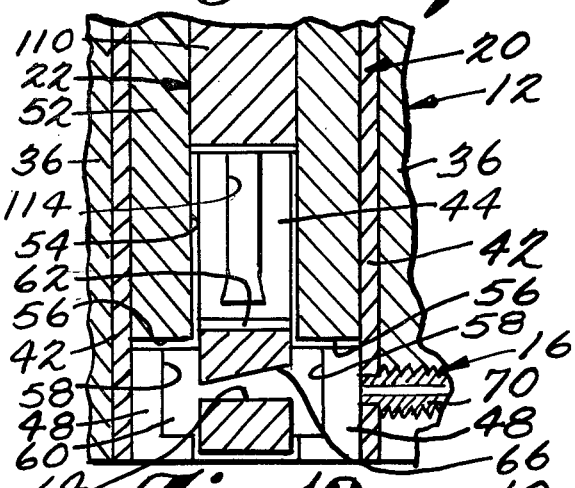
FIG. 11 is a fragmentary sectional view taken along the line 11—11 of FIG. 4.
Figure 12:
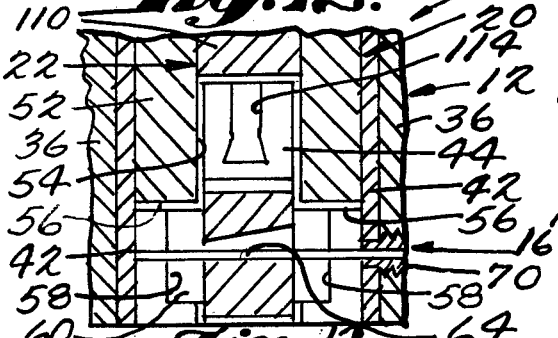
FIG. 12 is a fragmentary sectional view taken along the line 12—12 of FIG. 5.

It will also be understood that while the drawings do not include an illustration of the spool of wire constituting the wire supply from which the staples are formed, any suitable means may be provided for rotatably supporting such a spool so that the wire therein may be drawn downwardly and fed through the vertical path of the wire supporting and guiding mechanism, through the transition tube 82 thereof and horizontally through the straightening assembly 72 into the shearing tube or member 70. The cycle of operation will be described with the wire initially fed in the manner indicated to the shearing member 70 and all of the other parts of the device disposed in their uppermost position as viewed in FIG. 4. When the pneumatic piston and cylinder unit 117 is utilized, the effect of pressurizing the same is to begin the downward operative stroke of the arm 112 of the motion transmitting mechanism 24. During initial portion of the downward movement of the arm 112 a downward oscillatory stoke or pivotal movement of the lever 118 takes place by virtue of the engagement of the lever engaging surface 132 of the latch member 128 with the upper intermediate portion of the lever. This initial vertical extent of movement imparted to the lever 118 results in a downward movement of the pawl carrying member 90 through a feeding stroke, the vertical extent of which by virtue of the pin and slot connection 122 and 124, is approximately twice the vertical extent of the initial portion of the operative vertical stroke of the arm 112. During the feeding stroke of the pawl carrying member 90, roller pawl 94 is engaged with the wire extending along the vertical wire path so as to connect the wire with the pawl carrying member 90 for movement therewith through its feeding stroke. During this movement, the end of the wire is moved from a position adjacent the end of shearing member 70 as shown in FIG. 11 through the tapered slot of the anvil member 60 and into engagement with the butting surface provided by the leg of front wall 42, as shown in FIG. 12. The end section of the wire is then positioned with its free end in engagement with the abutment surface, its central portion disposed over the anvil surface 64 and its opposite end extending from the shearing member 70.

The end of the initial portion of the downward operative stroke of the arm 112 is also signalled by the cam roller 134 leaving the cam track 138, thus allowing the latch member 128 to be moved rearwardly out of motion transmitting relation with respect to the lever 118, so that at the end of the movement lever 118 remains stationary together with the pawl carrying member 90. The arrangement is such that when the end of the wire reaches the abutment surface, this resistance to the further downward movement of the pawl carrying member 90 is transmitted to the latch member 128 through the engagement of surface 132, the contour of the cam track 138 being such as to insure a rearward movement of the latch member 128 when the aforesaid resistance is met. In this way, a full feeding stroke of the wire into engagement with the abutment surface along the horizontal path is insured.

Figure 13:
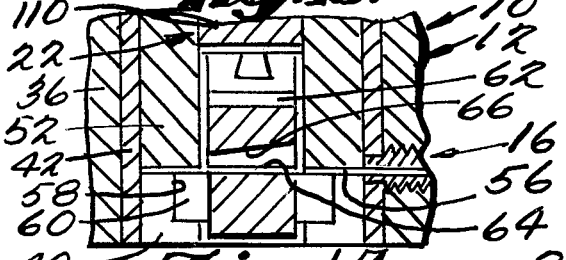
FIG. 13 is a view similar to FIG. 12 showing the position of the parts during the wire cutting operation.
Figure 14:
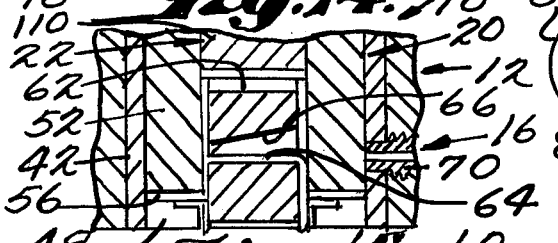
FIG. 14 is a view similar to FIG. 12 showing the position of the parts during the staple forming operation.

It will also be noted that during this initial portion of the downward operative stroke of the arm 112, staple driving element 110 is moved downwardly through a portion of its drive stroke which corresponds with the portion of the movement of the arm 112. During this initial portion of the operative stroke of the arm 112, the surface 158 thereof moves along pin 140 and the cutting and forming member 52 is yieldingly retained in a stationary position by virtue of the engagement of the spring detent 182 within the notch 184. At the end of this portion of the operative stroke of the arm 112, surface 160 engages the pin 140 so that as the arm 112 continues downwardly in the next intermediate portion of its operative stroke, pin 140 will be moved downwardly by virtue of the engagement of surface 160 therewith. Since the pin 140 engages the arm portions 154 of the bifurcated portion 150 of the staple cutting and forming member 52, the downward movement of the pin 140 will be transmitted into a corresponding downward movement of the wire cutting and forming member 52 downwardly from its yieldably retained stationary position. During this movement, the grooves 56 within the lower surfaces of the member 52 receive the end section of the wire extending in both directions beyond the anvil surface 64, as shown in FIG. 13. The initial effect of this movement is to shear the end section of the wire from the remainder thereof by virtue of a shearing action between the shearing member 70 and the associated surface of the member 52. As the downward movement continues the cut-off end section of the wire is bent over the opposite ends of the anvil surface 62 until the end section is moved into an inverted U-shaped configuration, as shown in FIG. 14, with the crown thereof being disposed over the anvil surface 64 and the legs being disposed within the associated portions of the grooves 54 within the legs of the cutting and forming member 52.

At this position, rearwardly facing and downwardly inclined cam surfaces 108 engage on the inclined cam surfaces 67 on the anvil member so that upon further downward movement of the forming member 52, anvil member 60 is cammed rearwardly against the action of spring 68. Since staple driving element 110 is directly connected with the arm 112, it continues to move downwardly during the intermediate portion of the operative stroke of the arm 112. When the pin 140 reaches transition surface 144 and engages the lower surfaces 146, the arm surface 160 moves out of motion transmitting engagement with the pin 140. However, the engagement of the lower end of the staple driving element 110 with cam surface 62 of the anvil member 60 continues the rearward movement of the anvil member into its retained position allowing the fastener driving element to move downwardly thereby. At this position, the central portion of the spring 166 engages the upper surface of arm portions 152, thus serving to provide a bias for the further downward movement of the cutting and forming member 52 in addition to its gravity and inertia.

Figure 15:
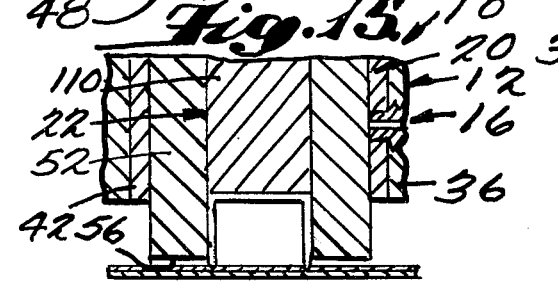
FIG. 15 is a view similar to FIG. 12 showing the position of the parts during the staple driving operation.
Figure 3:
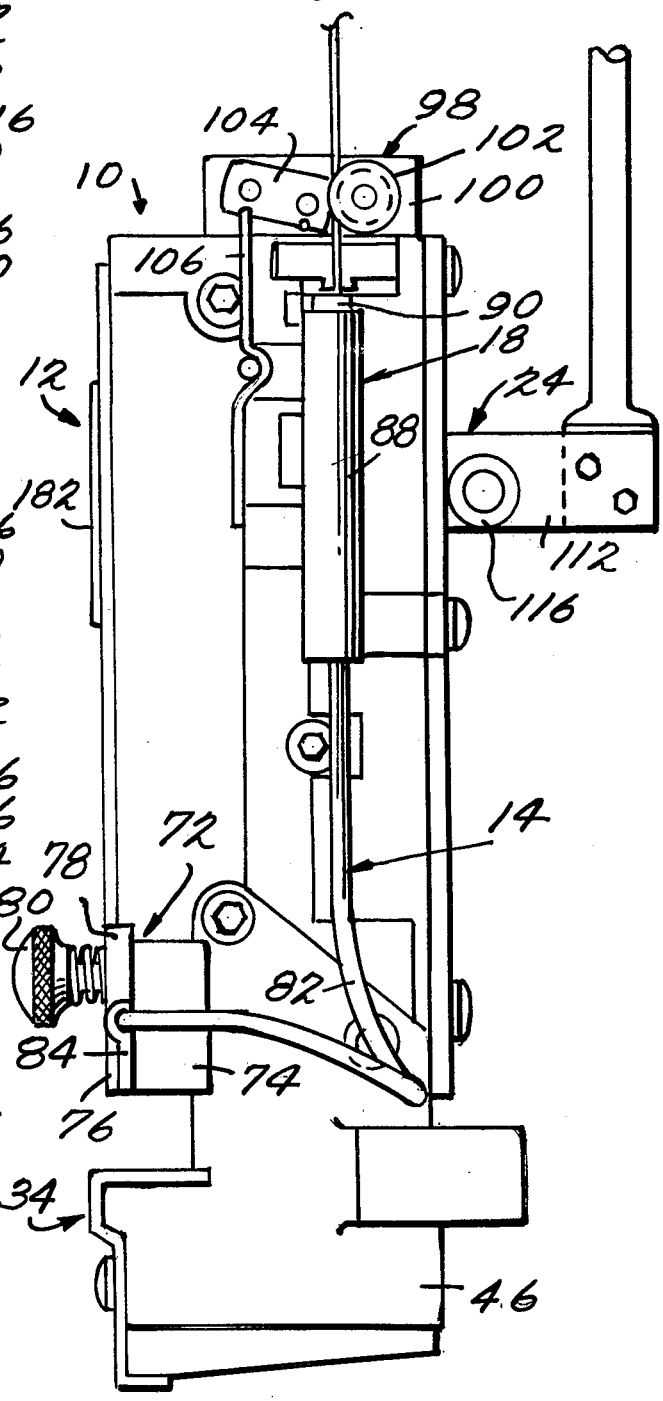
FIG. 3 is a side elevational view of the device shown in FIG. 1.
Figure 5:
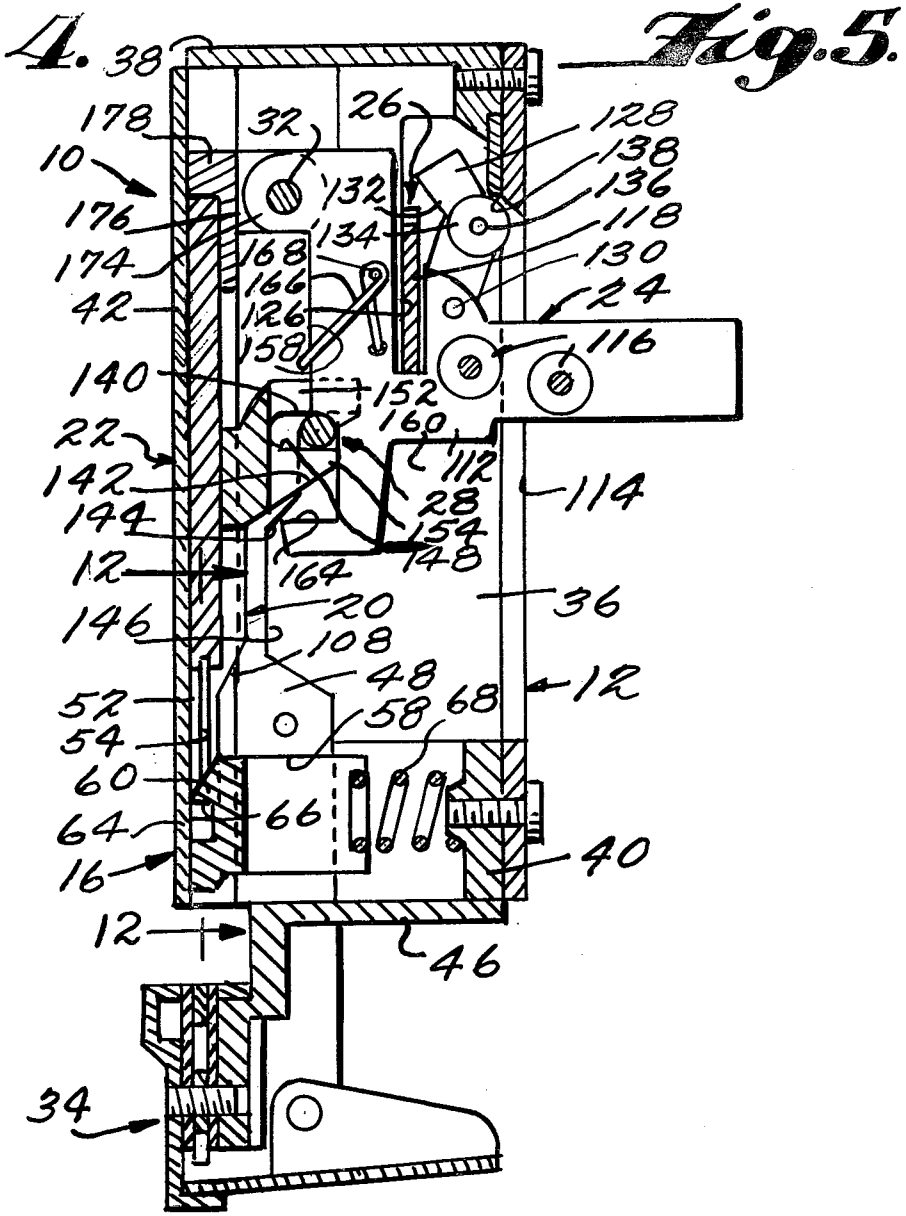
FIG. 5 is a view similar to FIG. 4 showing the position of the parts after the motion transmitting member has been moved through an initial position of its operative drive stroke.

As the arm 112 continues through a final portion of its downward operative stroke, the crown of the staple is received within the grooved lower end of the staple driving element 110 and the lower end of the cutting and forming member 52 is resiliently engaged to the upper surface of the workpiece by virtue of the operation of spring 166, as shown in FIG. 15.

Further downward movement of the cutting and forming member 52 is prevented by virtue of the engagement thereof with the workpiece, however, the staple driving member 110 continues downwardly carrying with it the formed staple downwardly into the workpiece. Where the clincher is used, the free ends of the legs of the U-shaped staple pass through the workpiece and are clinched thereover by the clinching mechanism 34. The clinching mechanism may be of any known construction including power a actuated movable or flat clinching mechanisms (see for example U.S. Pat. No. 1,036,841 the disclosure of which is hereby incorporated by reference into the present specification) or standard fixed or non-flat clinching mechanisms.

It will be noted that during the downward movement of the staple into and through the workpiece, the legs are captured within the grooves 54, while the crown of the staple is captured in the downwardly opening groove on the bottom surface of the staple driving element 110. The grooves 54 thus provide a guide track for the staple during the movement thereof into and through the workpiece. Also, it will be noted that since the arm 112 continues to move downwardly with the staple driving member 110, spring 116 continues to yield by virtue of the fact that the movement of the wire cutting and forming member 52 has been arrested by engagement with the workpiece.

It will be understood that the vertical extent of the staple driving stroke of the staple driving member 110 is determined by the thickness of the workpiece. Consequently, the variation in the length of the stroke must be accommodated. In the arrangement shown wherein the arm 112 is moved by a pneumatic piston and cylinder unit 117, such accommodation is made by virtue of the compression of the air in the unit 117 so that the vertical extent of the arm 112 is always the same as the staple driving member 110 with the aforesaid variation being accommodated by the power moving mechanism. Where the power moving mechanism is positively acting through a stroke which cannot be varied, the pin connection 32 can be modified to accommodate the variation in the length of the stroke of the staple driving member 110 as for example by a vertical slot and spring.

After the arm 112 has been moved through its downward operative stroke, it is then moved through its upward return stroke. During the initial portion of the return stroke, spring 166 which is stressed against the arm portions 152 is progressively unstressed until the surface 164 on the arm 112 engages the pin 140. Further upward movement in the return stroke of the arm 112 results in the pin 140 being carried upwardly with the arm which, in turn, results in the wire cutting and staple forming member 52 being carried upwardly therewith through its return stroke. As the arm 112 continues its upward movement during the return stroke thereof, lever 118 which is in its downward position engages with the slot 126 and is carried upwardly with the arm. The upward movement of the lever 118 effects a corresponding greater amount of upward movement of the pawl carrying member 90. During this movement, the tendency for the feeding pawl 94 to move the wire upwardly causes the holding pawl 104 to grip the wire with a camming action, thus preventing such upward movement and causing the feeding pawl 94 to move out of gripping relation with the wire against the action of spring 92. As the arm 112 continues its upward movement, cam roller 134 engages the cam track 138 moving the latching 128 forwardly until surface 132 thereof engages over the upper portion of the lever, thus capturing the same with movement of arm 112. It will also be understood that during the entire upward movement of the arm 112 through its return stroke, staple driving element 110 is correspondingly moved upwardly through a corresponding return stroke.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A stapling device for use with a staple supply in the form of a roll of wire comprising a housing assembly, means for supporting a roll of wire so that the wire can be unwound from the roll by extending an end portion thereof from the roll and for supporting the end portion for movement along a vertical path terminating in a horizontal path, wire receiving means on said housing assembly for receiving an end section disposed along said horizontal path of the extended end portion of the wire, wire feeding means mounted on said housing assembly for reciprocating movement along said vertical wire path through successive cycles each of which includes (1) a downward feeding stroke during which the end portion of the wire is moved with respect to said receiving means so that an end section thereof is received therein and (2) an upward return stroke, wire cutting and staple forming means mounted on said housing assembly for vertical cooperative reciprocating movement with respect to said receiving means through successive operative cycles each of which includes (1) a downward cutting and forming stroke during which the end section of wire received by said receiving means is cut from said wire end portion and formed into a U-shaped staple and (2) an upward return stroke, staple driving means mounted on said wire cutting and staple forming means for vertical reciprocating movement through successive operative cycles each of which includes (1) a downward staple driving stroke during which a U-shaped staple formed by said cutting and forming means is driven into a workpiece and (2) an upward return stroke, a motion transmitting member mounted on said housing assembly for vertical reciprocating movement through successive operative cycles each of which includes (1) a downward operative stroke equal in vertical extend to that of the staple driving stroke of said staple driving means and (2) a corresponding upward return stroke, means operatively connecting said motion transmitting member with said wire feeding means for moving the latter (1) through a downward feeding stroke in response to the movement of said motion transmitting member through an initial portion of its downward operative stroke of an extent less than the downward extent of said feeding stroke and (2) through an upward return stroke in response to the movement of said motion transmitting member through a portion of its upward return stroke, said means operatively connecting said motion transmitting member with said wire feeding means comprising a lever pivotally mounted on said housing assembly, a pin and slot connection between said lever and said feed member, a latch mounted on said motion transmitting member for movement therewith and for movement with respect thereto between a lever engaging position and a lever releasing position and means operable to effect movement of said latch between said lever engaging position and said lever releasing position during the feeding stroke and return stroke of said motion transmitting member so that said latch is disposed in said lever engaging position only during said initial portion of the downward stroke of said motion transmitting member and a corresponding final portion of the return stroke of said motion transmitting member, means operatively connecting said motion transmitting member with said wire cutting and staple forming means for moving the latter (1) through a downward cutting and forming stroke in response to the movement of said motion transmitting member through an intermediate portion of its downward operative stroke of a vertical extent equal to the vertical extent of said cutting and forming stroke so that after an end section of wire has been moved into received relation with said wire receiving means by said wire feeding mean it is cut therefrom and formed into a U-shaped staple thereby and (2) through an upward return stroke in response to the movement of said motion transmitting member through a portion of its upward return stroke, and means for operatively connecting said motion transmitting means with said staple driving means for moving the latter (1) through a staple driving stroke in response to the movement of said motion transmitting member through its downward operative stroke so that during the final portion thereof a cut and formed staple is driven into the workpiece and (2) through an upward return stroke in response to the movement of said motion transmitting member through its upward return stroke.

2. A stapling device as defined in claim 1 wherein said wire cutting and staple forming means comprises an inverted U-shaped member, and said staple driving means includes a driving element mounted for movement through its operative cycle in a position between the legs of said inverted U-shaped member.

3. A stapling device as defined in claim 2 wherein said wire receiving means includes a fixed abutment for engaging the leading extremity of the wire when the end section thereof is moved through the aforesaid horizontal path and a fixed wire shearing element spaced horizontally from said fixed surface along said horizontal path, and an anvil member spaced between said fixed abutment and said shearing element in a position below said horizontal path mounted for horizontal reciprocating movement between a staple forming position disposed below the end section of a wire extending from said shearing element to said abutment and a staple driving position disposed in horizontally spaced relation from a formed staple, said U-shaped member being operable during the downward cutting and forming stroke to shearingly cooperate with said shearing element to cut the end section of the wire and to cooperate with said anvil member to bend the ends of the end section of the wire downwardly over said anvil member, said driving element being operable during its downward staple driving stroke to move said anvil member from its staple forming position into its staple driving position.

4. A stapling device as defined in claim 1 wherein said last mentioned means comprises cam tracks on said housing structure and cam rollers on said latch.

5. A stapling device for use with a staple supply in the form of a roll of wire comprising a housing assembly, means for supporting a roll of wire so that the wire can be unwound from the roll by extending an end portion thereof from the roll and for supporting the end portion for movement along a vertical path terminating in a horizontal path, wire receiving means on said housing assembly for receiving an end section disposed along said horizontal path of the extended end portion of the wire, wire feeding means mounted on said housing assembly for reciprocating movement along said vertical wire path through successive cycles each of which includes (1) a downward feeding stroke during which the end portion of the wire is moved with respect to said receiving means so that an end section thereof is received therein and (2) an upward return stroke, wire cutting and staple forming means mounted on said housing assembly for vertical cooperative reciprocating movement with respect to said receiving means through successive operating cycles each of which includes (1) a downward cutting and forming stroke during which the end section of wire received by said receiving means is cut from said wire end portion and formed into a U-shaped staple and (2) an upward return stroke, said wire cutting and staple forming means comprising an inverted U-shaped member, staple driving means mounted on said wire cutting and staple forming means for vertical reciprocating movement through successive operative cycles each of which includes (1) a downward staple driving stroke during which a U-shaped staple formed by said cutting and forming means is driven into a workpiece and (2) an upward return stroke, said staple driving means including a driving element mounted for movement through its operative cycle in a position between the legs of said U-shaped member, a motion transmitting member mounted on said housing assembly for vertical reciprocating movement through successive operative cycles each of which includes (1) a downward operative stroke equal in vertical extent to that of the staple driving stroke of said staple driving means and (2) a corresponding upward return stroke, means operatively connecting said motion transmitting member with said wire feeding means for moving the latter (1) through a downward feeding stroke in response to the movement of said motion transmitting member through an initial portion of its downward operative stroke of an extent less than the downward extent of said feeding stroke and (2) through an upward return stroke in response to the movement of said motion transmitting member through a portion of its upward return stroke, means operatively connecting said motion transmitting member with said wire cutting and staple forming means for moving the latter (1) through a downward cutting and forming stroke in response to the movement of said motion transmitting member through an intermediate portion of its downward operative stroke of a vertical extend equal to the vertical extent of said cutting and forming stroke so that after an end section of wire has been moved into received relation with said wire receiving means by said wire feeding means it is cut therefrom and formed into a U-shaped staple thereby and (2) through an upward return stroke in response to the movement of said motion transmitting member through a portion of its upward return stroke, said means operatively connecting said motion transmitting member with said wire cutting and forming means comprising means on said U-shaped member defining a horizontally elongated pin receiving slot, a a pin extending through said slot operatively retained therein for relative horizontal movement so that said U-shaped member is moved vertically in response to the vertical movement of said pin, and pin engaging surface means on said housing assembly and said motion transmitting member for (1) enabling said motion transmitting member to be moved through an initial portion of its operative stroke out of motion transmitting relation with said pin so that during such movement said U-shaped member can be retained in an initial stationary position, (2) enabling said motion transmitting member to be moved through a second portion of its operative stroke in motion transmitting relation with said pin so that during such movement said U-shaped member is moved vertically therewith and (3) enabling said motion transmitting member to be moved through a final portion of its operative stroke out of motion transmitting relation with said pin so that during such movement said U-shaped member can be independently biased to move downwardly, and means for operatively connecting said motion transmitting means with said staple driving means for moving the latter (1) through a staple driving stroke in response to the movement of said motion transmitting member through its downward operative stroke so that during the final portion thereof a cut and formed staple is driven into the workpiece and (2) through an upward return stroke in response to the movement of said motion transmitting member through its upward return stroke.

6. A stapling device as defined in claim 5 wherein said inverted U-shaped member includes a bight portion and parallel vertical leg portions extending downwardly therefrom, said legs having vertical opposed grooves formed in the interior surfaces thereof of a size to cooperatively receive said wire therein, said staple driving means including a driving member mounted between said leg portions and having opposite edge portions slidably mounted in said grooves.

7. A stapling device as defined in claim 6 wherein the slot in said U-shaped member is formed in a bifurcated portion extending rearwardly of the bight portion thereof, said motion transmitting member extending between the bifurcations of said bifurcated portion.

8. A stapling device as defined in claim 7 wherein the slot in said bifurcated portion is open rearwardly.

9. A stapling device as defined in claim 8 wherein said driving member has a slot formed in the lower surface thereof of a size to cooperatively receive said wire therein.

10. A stapling device as defined in claim 5, 6, 7, 8 or 9 wherein said pin engaging surface means on said housing assembly includes (1) upper rearwardly facing surface means for engaging opposite end portions of said pin and preventing relative forward horizontal movement thereof within said slot during an initial portion of the cutting and forming stroke of said U-shaped member, (2) downwardly and rearwardly facing surface means for engaging opposite end portions of said pin and permitting controlled relative forward movement of said pin within said slot during a second predetermined portion of the cutting and forming stroke of said U-shaped member and (3) lower rearwardly facing surface means for engaging opposite end portions of said pin and preventing relative forward horizontal movement thereof within said slot during a final portion of the cutting and forming stroke of said U-shaped member, said pin engaging surface means on said motion transmitting member including (1) lower forwardly facing surface means for engaging said pin and preventing a relative rearward horizontal movement thereof within said slot during a initial portion of the operative stroke of said motion transmitting member, (2) downwardly and forwardly facing surface means for engaging said pin and effecting a downward and forward movement thereof under the control of said downwardly and rearwardly facing surface means during a second predetermined portion of the operative stroke of said motion transmitting member and (3) upper forwardly facing surface means for engaging said pin and preventing relative rearward movement thereof during a final portion of the operative stroke of said motion transmitting member.

11. A stapling device as defined in claim 5, 6, 7, 8 or 9 wherein said housing assembly carries yieldable means for releasably retaining said U-shaped member in said initial stationary position.

12. A stapling device as defined in claim 5, 6, 7, 8 or 9 wherein said motion transmitting member carries normally inoperable spring means operable when said motion transmitting member is moved through said final portion of its operative stroke out of motion transmitting relation with said pin to yieldably bias said U-shaped member downwardly.

13. A stapling device for use with a staple supply in the form of a roll of wire comprising a housing assembly, means for supporting a roll of wire so that the wire can be unwound from the roll by extending an end portion thereof from the roll and for supporting the end portion for movement along a path terminating in a horizontal path, wire receiving means on said housing assembly for receiving an end section disposed along said horizontal path of the extended end portion of the wire, wire feeding means mounted on said housing assembly for movement through a feeding stroke during which the end portion of the wire is moved with respect to said receiving means so that an end section thereof is received therein, an inverted U-shaped member mounted on said housing assembly for vertical cooperative movement with respect to said receiving means through a downward cutting and forming stroke during which the end section of wire received by said receiving means is cut from said wire end portion and formed into a U-shaped staple, staple driving means mounted on said U-shaped member for vertical movement through a downward staple driving stroke during which a U-shaped staple formed by said cutting and forming means is driven through a workpiece, a motion transmitting member mounted on said housing assembly for vertical movement through a downward operative stroke equal in vertical extent to that of the staple driving stroke of said staple driving means, means for moving said wire feeding means through a downward feeding stroke during the movement of said motion transmitting member through an initial portion of its downward operative stroke, means operatively connecting said motion transmitting member with said U-shaped member for moving the latter through a downward cutting and forming stroke in response to the movement of said motion transmitting member through an intermediate portion of its downward operative stroke of a vertical extent equal to the vertical extent of said cutting and forming stroke so that after an end section of wire has been moved into received relation with said wire receiving means by said wire feeding means it is cut therefrom and formed into a U-shape staple thereby, means for operatively connecting said motion transmitting means with said staple driving means for moving the latter through a staple driving stroke in response to the movement of said motion transmitting member through its downward operative stroke so that during the final portion thereof a cut and formed staple is driven through the workpiece, said means operatively connecting said motion transmitting member with said U-shaped member comprising means on said U-shaped member defining a horizontally elongated pin receiving slot, a pin extending through said slot operatively retained therein for relative horizontal movement so that said U-shaped member is moved vertically in response to the vertical movement of said pin, and pin engaging surface means on said housing assembly and said motion transmitting member for (1) enabling said motion transmitting member to be moved through an initial portion of its operative stroke out of motion transmitting relation with said pin so that during such movement said U-shaped member can be retained in an initial stationary position, (2) enabling said motion transmitting member to be moved through a second portion of its operative stroke in motion transmitting relation with said pin so that during such movement said U-shaped member is moved vertically therewith and (3) enabling said motion transmitting member to be moved through a final portion of its operative stroke out of motion transmitting relation with said pin so that during such movement said U-shaped member can be independently biased to move downwardly.

14. A stapling device as defined in claim 13 wherein said inverted U-shaped member includes a bight portion and parallel vertical leg portions extending downwardly therefrom, said legs having vertical opposed grooves formed in the interior surfaces thereof of a size to cooperatively receive said wire therein, said staple driving means including a driving member mounted between said leg portions and having opposite edge portions slidably mounted in said grooves.

15. A stapling device as defined in claim 14 wherein the slot in said U-shaped member is formed in a bifurcated portion extending rearwardly of the bight portion thereof, said motion transmitting member extending between the bifurcations of said bifurcated portion.

16. A stapling device as defined in claim 15 wherein the slot in said bifurcated portion is open rearwardly.

17. A stapling device as defined in claim 16 wherein said driving member has a slot formed in the lower surface thereof of a size to cooperatively receive said wire therein.

18. A stapling device as defined in claim 13, 14, 15, 16 or 17 wherein said pin engaging surface means on said housing assembly includes (1) upper rearwardly facing surface means for engaging opposite end portions of said pin and preventing relative forward horizontal movement thereof within said slot during an initial portion of the cutting and forming stroke of said U-shaped member, (2) downwardly and rearwardly facing surface means for engaging opposite end portions of said pin and permitting controlled relative forward movement of said pin within said slot during a second predetermined portion of the cutting and forming stroke of said U-shaped member and (3) lower rearwardly facing surface means for engaging opposite end portions of said pin and preventing relative forward horizontal movement thereof within said slot during a final portion of the cutting and forming stroke of said U-shaped member, said pin engaging surface means on said motion transmitting member including (1) lower forwardly facing surface means for engaging said pin and preventing a relative rearward horizontal movement thereof within said slot during an initial portion of the operative stroke of said motion transmitting member (2) downwardly and forwardly facing surface means for engaging said pin and effecting a downward and forward movement thereof under the control of said downwardly and rearwardly facing surface means during a second predetermined portion of the operative stroke of said motion transmitting member and (3) upper forwardly facing surface means for engaging said pin and preventing relative rearward movement thereof during a final portion of the operative stroke of said motion transmitting member.

19. A stapling device as defined in claim 13, 14, 15, 16 or 17 wherein said housing assembly carries yieldable means for releasably retaining said U-shaped member in said initial stationary position.

20. A stapling device as defined in claim 13, 14, 15, 16 or 17 wherein said motion transmitting member carries normally inoperable spring means operable when said motion transmitting member is moved through said final portion of its operative stroke out of motion transmitting relation with said pin to yieldably bias said U-shaped member downwardly.

* * * * *